US008418661B2

(12) United States Patent
Kanda et al.

(10) Patent No.: US 8,418,661 B2
(45) Date of Patent: Apr. 16, 2013

(54) COMBUSTION APPARATUS

(75) Inventors: Yoshinori Kanda, Takasago (JP); Takeshi Wakada, Kobe (JP); Toshio Watanabe, Akashi (JP); Takashi Akiyama, Kobe (JP); Takashi Wakatake, Akashi (JP)

(73) Assignee: Noritz Corporation, Hyogo (JP)

( * ) Notice: Subject to any disclaimer, the term of this patent is extended or adjusted under 35 U.S.C. 154(b) by 813 days.

(21) Appl. No.: 12/625,021

(22) Filed: Nov. 24, 2009

(65) Prior Publication Data

US 2010/0126431 A1 May 27, 2010

(30) Foreign Application Priority Data

Nov. 27, 2008 (JP) ..... 2008-303190
Nov. 27, 2008 (JP) ..... 2008-303201

(51) Int. Cl.
*F23N 1/02* (2006.01)

(52) U.S. Cl.
USPC ..... 122/33; 122/31.1; 431/12; 431/280

(58) Field of Classification Search ..... 122/31.1, 122/18.1, 33, 37; 431/12, 159, 162, 174, 431/195, 280, 278
See application file for complete search history.

(56) References Cited

U.S. PATENT DOCUMENTS 2,949,235 A * 8/1960 Stout ..... 236/26 R
5,513,979 A * 5/1996 Pallek et al. ..... 431/90
7,494,337 B2 * 2/2009 Specht et al. ..... 431/283
7,628,123 B2 * 12/2009 Inami et al. ..... 122/448.3
7,647,897 B2 * 1/2010 Ootomo et al. ..... 122/33
7,955,072 B2 * 6/2011 Ojiro et al. ..... 431/181
8,210,132 B2 * 7/2012 Asakura et al. ..... 122/18.1
8,267,051 B2 * 9/2012 Ando ..... 122/18.1

FOREIGN PATENT DOCUMENTS

JP 2000-146163 A 5/2000

* cited by examiner

*Primary Examiner* — Gregory A Wilson
(74) *Attorney, Agent, or Firm* — Rader, Fishman & Grauer PLLC

(57) ABSTRACT

A combustion apparatus 51 includes a plurality of burners 58, a plurality of fuel supply channels 89, a blower 53, an air supply passage 37, and a pressure regulator 56. The burners 58 are divided into a plurality of burner groups 71. The pressure regulator 56 is branched at a portion located immediately after a gas outlet 31 at downstream of the regulator 56 and connected to the respective fuel supply channels 89, so as to regulate gas supplied at a primary pressure to gas at a secondary pressure in response to a predetermined signal pressure sensed from one selected from a part of the air supply passage 37 and the blower 53 and to discharge the regulated gas through the pressure regulator 56. The fuel supply channels 89 each are configured to perform fuel supply to the respective burner groups 71 and are provided with a switching valve 75 for either shutting off or reducing the fuel supply to at least a part of the burner groups 71.

5 Claims, 12 Drawing Sheets

COMBUSTION APPARATUS

BACKGROUND OF THE INVENTION

1. Field of the Invention

The present invention relates to a combustion apparatus used in a device such as a water heater.

2. Description of the Related Art

Recently, water heaters are in widespread use at home. Water heaters for household use must supply hot water to a number of places solely by itself. For example, each family has water taps or showers in a kitchen, a bathroom, a wash-basin in its house. One water heater supplies hot water to those. Further, a large number of water heaters for household use have functions such as filling a bathtub with hot water and heating a remaining bath water again.

In this way, since hot water is used at a plurality of places by using a water heater for household use, the required amount and temperature of water change frequently. Thus, a combustion apparatus incorporated in such a water heater must change a combustion amount in response to a change of the amount and temperature of water.

For that reason, a combustion apparatus incorporated in a water heater for household use is provided with a gas proportional valve so as to change the combustion amount. More specifically, the combustion amount is changed by controlling the amount of fuel gas by regulating a valve opening degree of the proportional valve, which is disposed at a fuel supply channel of the combustion apparatus, in response to the required amount of heat generation.

The patent document 1 specified below discloses a combustion apparatus provided with a proportional valve at a fuel gas supply channel.

Patent Document 1: JP 2000-146163 A

SUMMARY OF THE INVENTION

Problem to be Solved by the Invention

A combustion apparatus in the conventional art sets a target value of a valve opening degree of a gas proportional valve and a target value of the rotation number of a blower so as to keep an air-fuel ratio within an allowable range, and electrically controls such devices so as to conform actual values of those described above to the target values.

Specifically, the combustion apparatus in the conventional art regulates the opening degree of the proportional valve to be conformed to the target opening degree of that, and simultaneously regulates the rotation number of the blower to be conformed to the target rotation number.

In a case where the required combustion amount has changed, the target values are recalculated so as to set new target values respectively. The apparatus regulates the opening degree of the proportional valve to be conformed to the new target value and simultaneously regulates the rotation number of the blower to be conformed to the new target value.

However, according to a configuration of the conventional art, the air-fuel ratio might be out of the allowable range until the opening degree of the proportional valve and the rotation number of the blower are conformed to the respective new target values in the case where the required combustion amount has changed, resulting in an unstable combustion. Therefore, the combustion apparatus in the conventional art has a technical problem to be solved such that combustion becomes unstable in the transition in changing of the combustion amount.

Further, though the fuel gas proportional valve is essential for the combustion apparatus of the conventional art, the proportional valve is a precision instrument to be electrically controlled, being generally expensive. Thus, there is a desire to dispense with the proportional valve.

Therefore, the present inventors experimentally produced a combustion apparatus 100, as shown in FIG. 14, having a configuration in which a pressure reducing valve (so-called zero governor) 6 of a direct acting type is connected to fuel gas supply channels so that a pressure signal for the pressure reducing valve 6 is taken out from a blower 3.

Herein, the pressure reducing valve 6 functions as a pressure regulator for reducing a primary pressure of supplied gas to a secondary pressure and for discharging the gas with the secondary pressure. Specifically, the pressure reducing valve 6 has a signal pressure inlet 32 through which a pressure is introduced as a signal, so as to discharge the gas with a pressure reduced to the secondary pressure in response to a pressure introduced through the signal pressure inlet 32.

In the combustion apparatus 100 experimentally produced by the present inventors, the pressure signal is taken out from the blower 3, so that a supply pressure of fuel gas is changed in accordance with increase and decrease of the air feeding amount. That solves the above-mentioned technical problem such as an unstable combustion in the transition in changing of the combustion amount. Further, the experimentally produced combustion apparatus 100 changes the combustion amount by changing of the air feeding amount by the blower 3, thereby dispensing with the fuel gas proportional valve 6.

Further, the combustion apparatus 100 includes four burners 8 (8*a*, 8*b*, 8*c*, and 8*d*) and four switching valves 5 (5*a*, 5*b*, 5*c*, and 5*d*) disposed at respective fuel supply channels for supplying fuel to the respective burners 8. Opening and closing of the switching valves 5 change the number of burners 8 in use for combustion. Consequently, the combustion apparatus 100 provides a high turndown ratio.

However, the combustion apparatus 100 has a drawback in which an air-fuel ratio might be out of the allowable range when the number of the burners 8 in use for combustion is changed. The combustion apparatus 100 includes a common flow channel 101 downstream of the pressure regulator 6. The common flow channel 101 is branched so as to communicate with a plurality of the fuel supply channels.

Specifically, in the combustion apparatus 100, fuel gas leading to all the burners 8 flows through the common flow channel 101. The flow rate of the fuel gas flowing through the common flow channel 101 is changed depending on the number of the burners 8 in use for combustion. In other words, the flow velocity of the fuel gas flowing through the common flow channel 101 is changed depending on the number of the burners 8 in use for combustion. As a consequence, the number of the burners 8 in use for combustion changes a flow resistance of the fuel gas flowing through the common flow channel 101. According to Bernoulli's law, the flow resistance is proportional to the square of the flow velocity of passing fluid. Thus, for example, in a case where some of the burners 8 are stopped during combustion, the flow velocity of the fuel gas passing through the common flow channel 101 is decreased, resulting in decreasing of the flow resistance, so that more fuel is supplied to the burners 8 in use for combustion. However, the amount of air supplied to the burners 8 stays unchanged. That is why, in the combustion apparatus 100, there is concern that the decreased number of the burners 8 in use for combustion might cause excessive fuel supply than that in the normal condition.

An object of the present invention made in view of the problems and drawbacks in the conventional art described above is therefore to further improve the experimentally produced combustion apparatus and develop a combustion apparatus ensuring a stable combustion by always securing a steady air-fuel ratio.

Means to Solve the Problem

In order to solve the problems and drawbacks described above, an aspect of the present invention provided herein is a combustion apparatus including a plurality of burners, a plurality of fuel supply channels through which fuel to be supplied to the burners passes, a blower for supplying air to the burners, an air supply passage disposed downstream of the blower and through which air to be supplied to the burners passes, and a pressure regulator having a gas outlet formed downstream in a gas flowing direction, being configured to regulate gas supplied at a primary pressure to gas at a secondary pressure in response to a predetermined signal pressure sensed from at least one selected from a part of the air supply passage and the blower, and discharging the regulated gas through the gas outlet, the burners being divided into a plurality of burner groups each consisting of at least one of the burners, the pressure regulator being branched at a portion located immediately after the gas outlet so that the portion is connected to the respective fuel supply channels, and the fuel supply channels each being configured to supply fuel to the respective burner groups and being provided with a switching valve for either shutting off or reducing fuel supply to at least a part of the burner groups.

In the combustion apparatus in this aspect, the number of the burners making up one burner group is discretionarily determined. One burner may constitute one burner group, or alternatively, more than one burner may constitute one burner group.

The fuel supply channels are designed to supply fuel to their respective burner groups.

The fuel supply channels preferably supply only fuel, but may supply fuel-air mixture gas.

The pressure regulator employed in the combustion apparatus in this aspect fulfills the same function as the pressure reducing valve (so-called zero governor) described above, for regulating a primary pressure of supplied gas to a secondary pressure in response to a predetermined signal pressure and discharging the gas with a pressure reduced to the secondary pressure.

Further, also in the combustion apparatus in this aspect, the secondary pressure regulated by the pressure regulator changes in response to an air pressure of the blower since a pressure signal of the pressure regulator is sensed from a part of the air supply passage or the blower. The present aspect connects the fuel supply channels to the pressure regulator at a portion downstream of the pressure regulator, so that the fuel gas with a pressure regulated to the secondary pressure is introduced into each of the fuel supply channels.

As described above, since the fuel supply channels discretely supply fuel to their respective burner groups, the fuel gas is supplied to each of the burner groups at a pressure changing in response to an air pressure. Therefore, the supply of fuel gas is changed only by changing of the air pressure, so that the apparatus dispenses with a gas proportional valve.

Further, since the amount of fuel gas supplied to each burner depends on the air pressure of the blower, a stable combustion is maintained in the transition in changing of the combustion amount.

Additionally, the combustion apparatus in this aspect has the switching valves at either a part or all of the fuel supply channels, so that closing of either a part or all of the switching valves shuts off fuel gas supplied to the burners. That achieves a high turndown ratio.

Further, in the combustion apparatus in this aspect, since the pressure regulator is branched at a portion located immediately after the gas outlet so that the portion communicates with the fuel supply channels, a common flow channel for fuel gas can be extremely short. Thus, even in a case where the number of the burners in use for combustion changes, the flow resistance exhibits less fluctuation. Consequently, according to the combustion apparatus in this aspect, an air-fuel ratio of each burner exhibits extremely less fluctuation even if the number of the burners in use for combustion changes.

It is recommended that the fuel supply channels have respective upstream open ends located at a same position to form an open-end member, to which the pressure regulator is connected at the portion located immediately after the gas outlet.

The combustion apparatus in this aspect simplifies a branch structure at the portion located immediately after the gas outlet since the upstream open ends of the fuel supply channels are located at the same position.

It is recommended that the fuel supply channels each have a portion with a predetermined cross-sectional area corresponding to a combustion capacity of the respective burner group and/or a flow resistance corresponding to a combustion capacity of the respective burner group.

In the combustion apparatus in this aspect, each of the fuel supply channels has a portion with a predetermined cross-sectional area and/or a flow resistance both corresponding to a combustion capacity of its burner group. Specifically, the fuel supply channel(s) supplying fuel to the burner group(s) having a large combustion capacity has a large cross-sectional area at the portion(s), whereas the fuel supply channel(s) supplying fuel to the burner group(s) having a small combustion capacity has a small cross-sectional area at the portion(s).

As to the flow resistance, the fuel supply channel(s) supplying fuel to the burner group(s) having a large combustion capacity has a small flow resistance, whereas the fuel supply channel(s) supplying fuel to the burner group(s) having a small combustion capacity has a large flow resistance.

Consequently, fuel gas discharged from the pressure regulator is distributed to the burner groups according to the portion with a predetermined cross-sectional area and/or the flow resistance. In other words, the fuel gas discharged from the pressure regulator is distributed to the burner groups according to the respective combustion capacities.

It is desirable that the open-end member is formed by the open ends radially arranged, that the fuel supply channels extend from the open ends so as to define an imaginary plane, and that the gas outlet of the pressure regulator is connected to the open-end member from a direction having vertical component relative to the imaginary plane. Herein, the gas outlet of the pressure regulator may be directly connected to the open-end member, or may be indirectly connected to the open-end member via a tubular portion disposed at downstream of the pressure regulator.

The combustion apparatus in this aspect proposes a preferred layout of the fuel supply channels, and employment of the present aspect allows the combustion apparatus to be miniaturized.

It is desirable that the fuel supply channels each have an open area at the open-end member depending on a combustion capacity of the respective burner group.

In the combustion apparatus in this aspect, the open area of each fuel supply channel at the open-end member depends on a combustion capacity of the respective burner group. Specifically, the fuel supply channel(s) supplying fuel to the burner group(s) having a large combustion capacity(ies) has a large open area of the channel(s), whereas the fuel supply channel(s) supplying fuel to the burner group(s) having a small combustion capacity(ies) has a small open area of the channel(s).

Consequently, fuel gas discharged from the pressure regulator is distributed to the burner groups according to the open areas. In other words, the fuel gas discharged from the pressure regulator is distributed to the burner groups according to the respective combustion capacities.

Advantageous Effect of the Invention

The combustion apparatus of the present invention has a high turndown ratio, being suitable to be incorporated in a device such as a water heater, further maintains a stable combustion in the transition in changing of the combustion amount, and further is effective in reducing of the number of components because dispensing with a fuel gas proportional valve.

Still further, the combustion apparatus has effective in avoiding an air-fuel ratio being out of the allowable range in the transition in changing of the combustion amount by using the switching valve.

DESCRIPTION OF THE PREFERRED EMBODIMENT

Now, an embodiment of the present invention will be described below in detail, making reference to the accompanying drawings.

Figure 1:
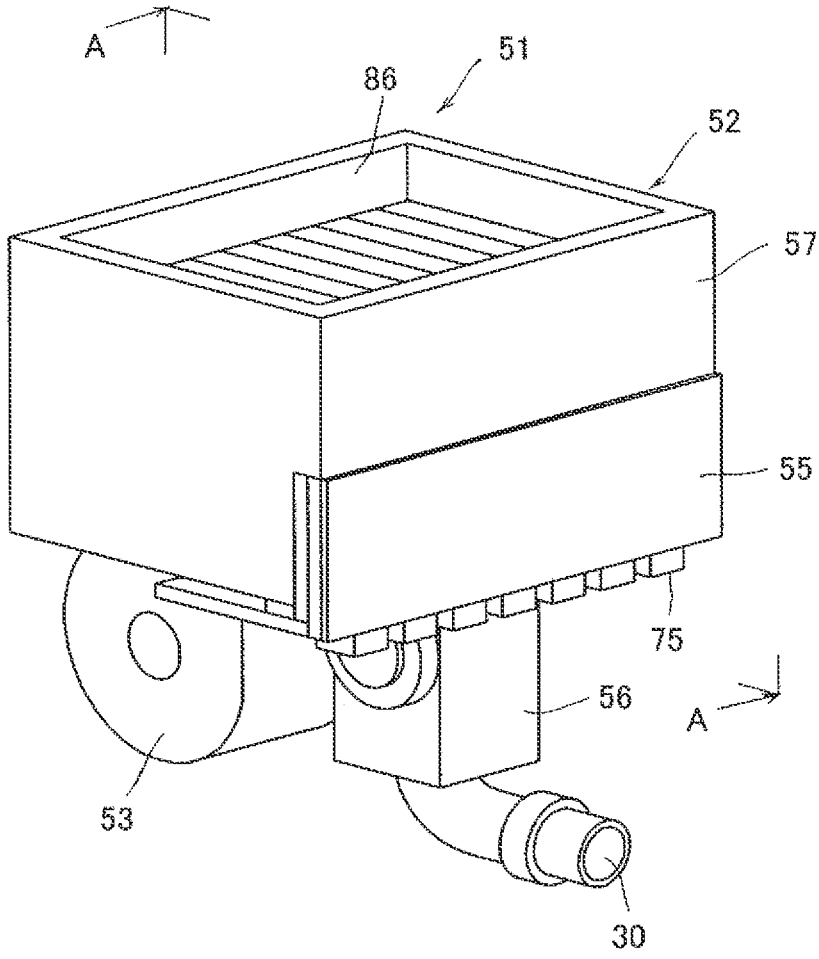
FIG. 1 is a perspective view of a combustion apparatus of an embodiment of the present invention.

A combustion apparatus 51 shown in FIG. 1 is designed to be incorporated in a water heater. The apparatus 51 mainly consists of a main body 52, a blower 53, a forming unit 55 for forming fuel supply channels, and a pressure regulator 56.

The blower 53 employed in the present embodiment is constituted by a moving vane housed rotatably in a casing. A motor (not shown) for driving the blower 53 can increase and decrease the rotation number of the moving vane. The blower 53 has a portion 80 for taking out a signal pressure (FIG. 5) opening adjacent to an air outlet.

The main body 52 includes twenty burners 58 housed in a burner casing 57, in which the burners 58 are divided into seven burner groups 71.

Figure 2:
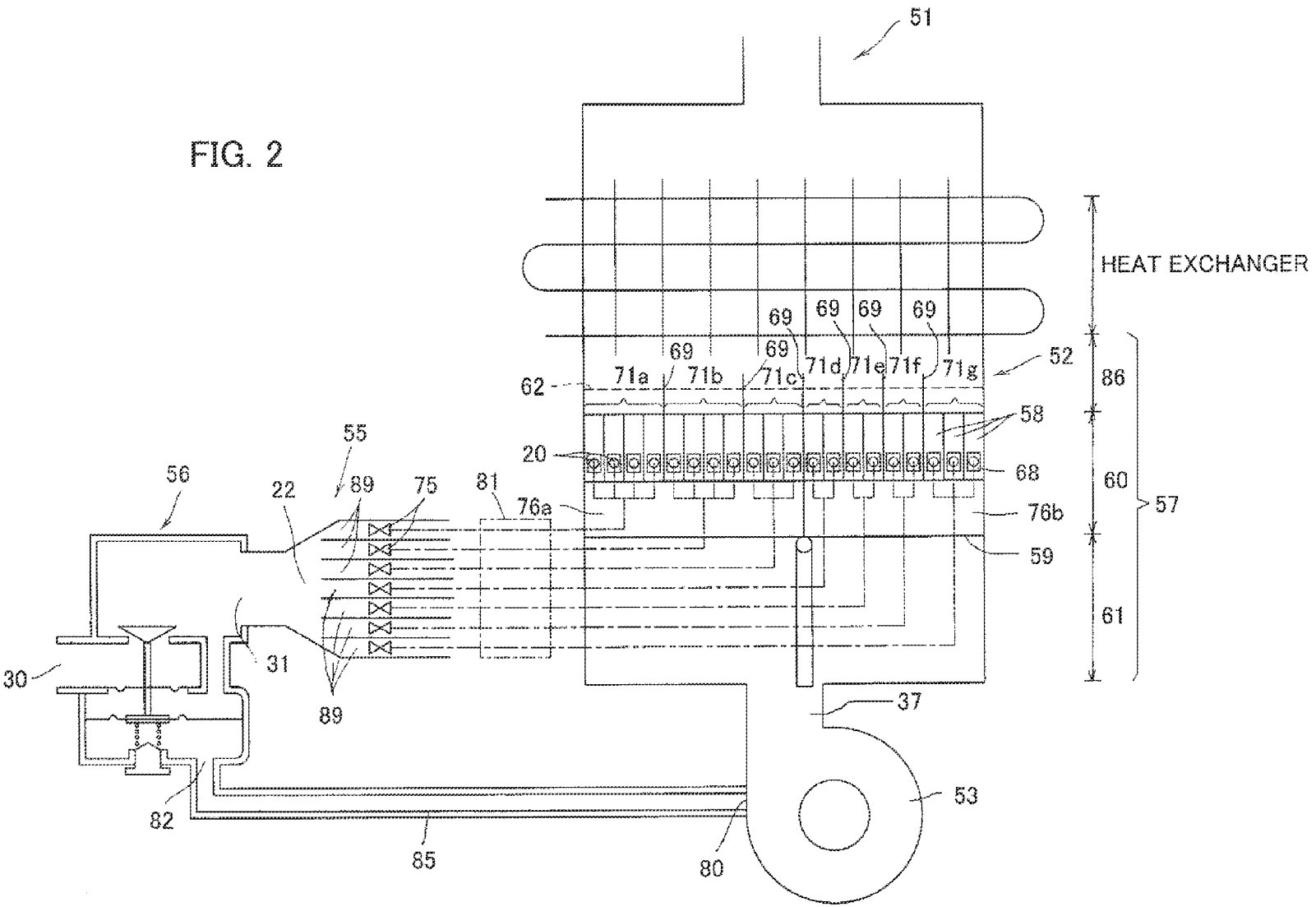
FIG. 2 is a plumbing diagram of the combustion apparatus in FIG. 1.
Figure 3:
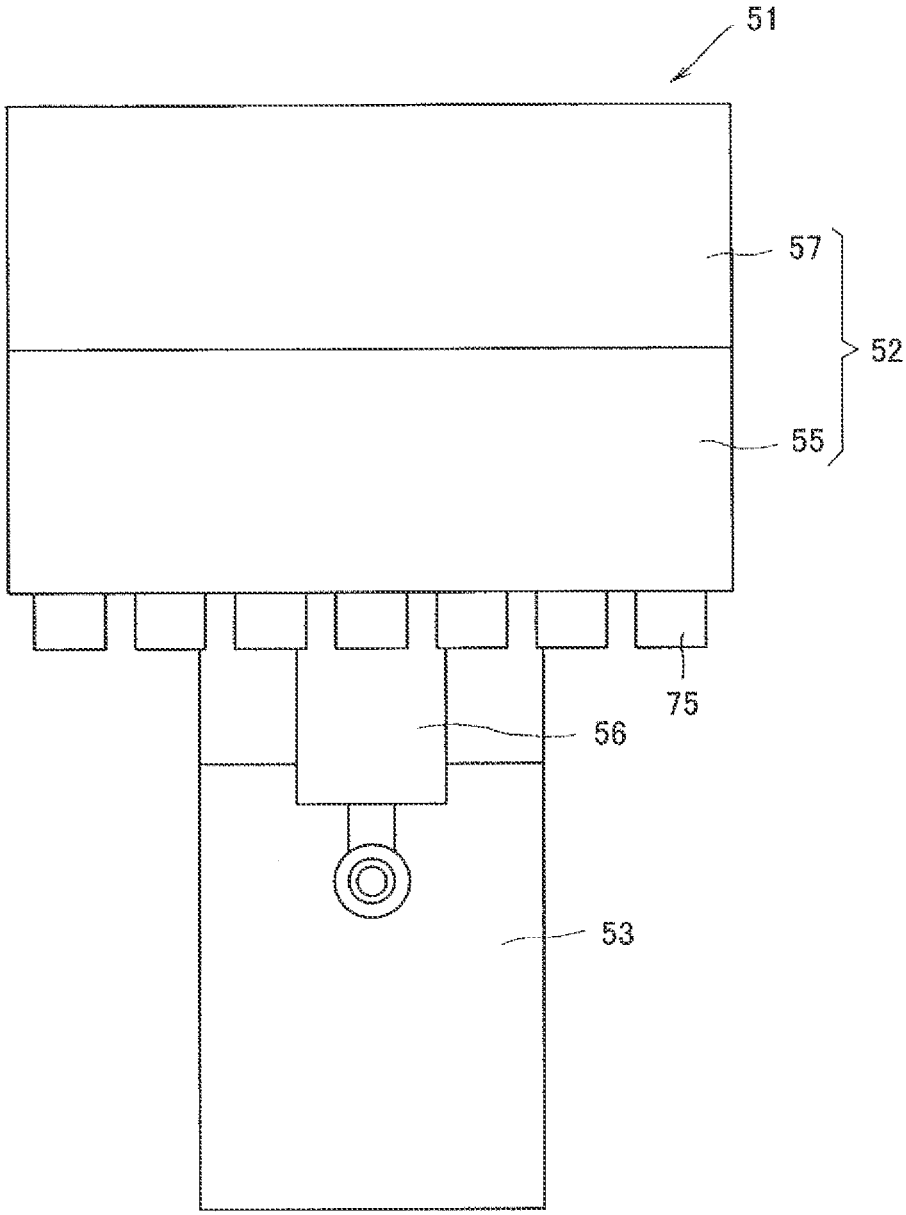
FIG. 3 is a front view of the combustion apparatus in FIG. 1.

Specifically, as shown in FIG. 2, a first group 71*a* consists of four burners 58, a second group 71*b* consists of four burners 58, a third group 71*c* consists of three burners 58, a fourth group 71*d* consists of two burners 58, a fifth group 71*e* consists of two burners 58, a sixth group 71*f* consists of two burners 58, and a seventh group 71*g* consists of three burners 58.

Figure 4:
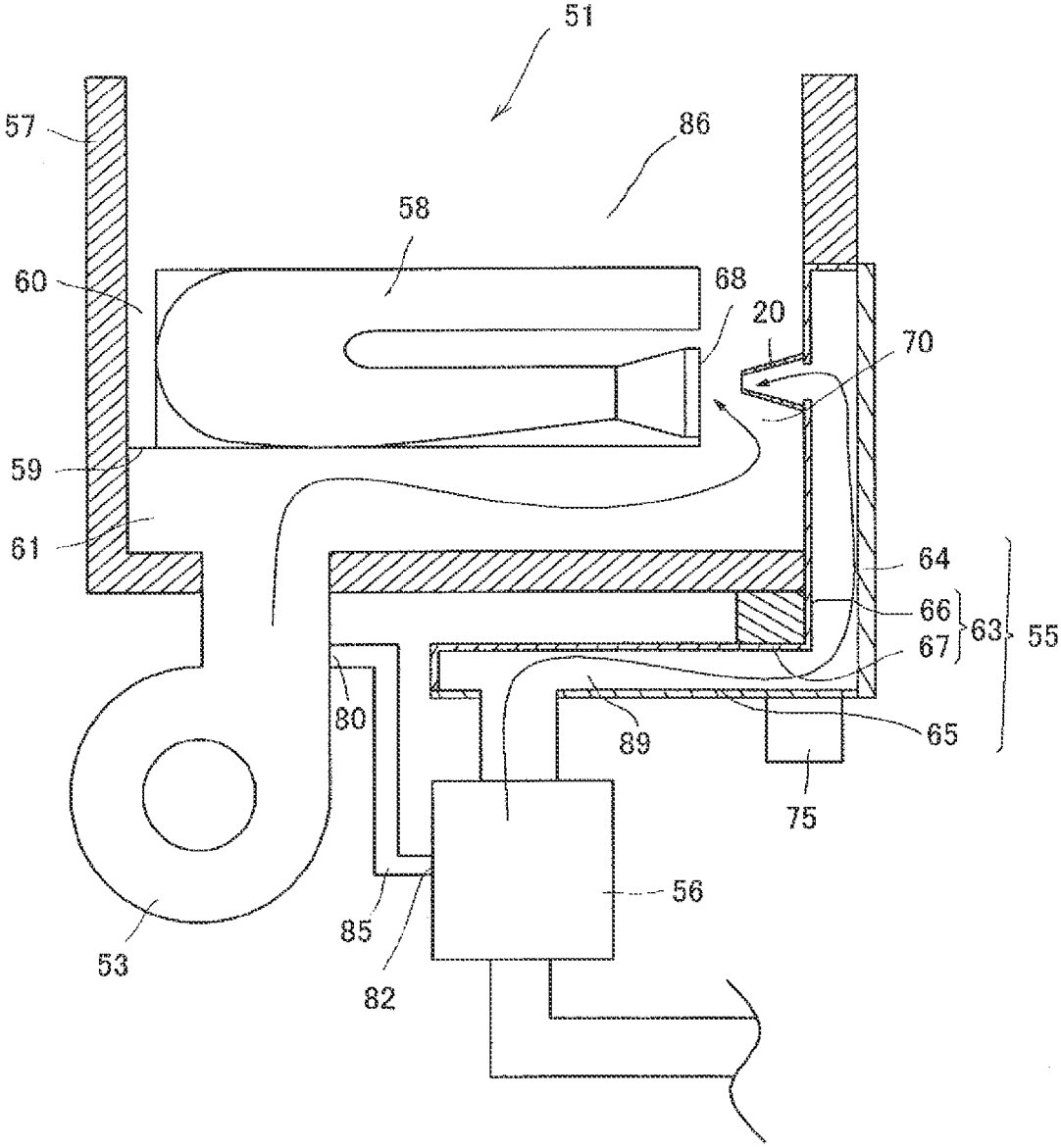
FIG. 4 is a cross section taken along a line A-A in FIG. 1.
Figure 6:
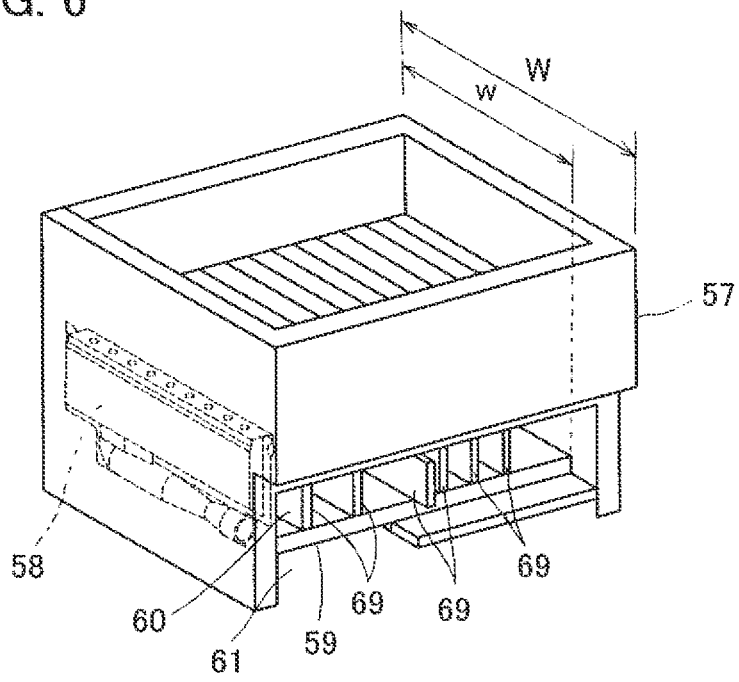
FIG. 6 is an exploded perspective view of a burner casing.
Figure 7:
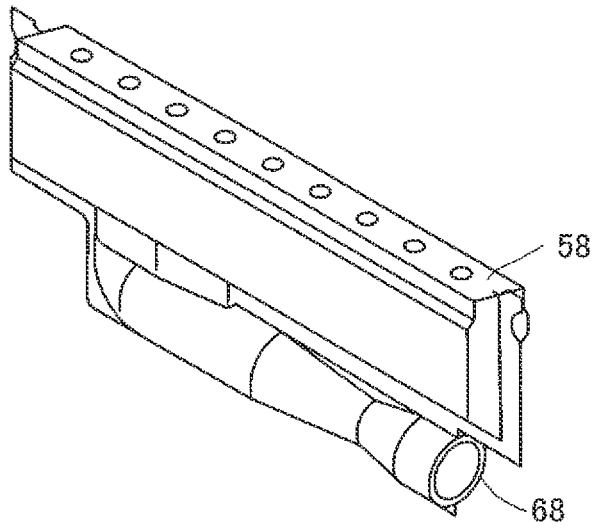
FIG. 7 is a perspective view of a burner housed in the burner casing.

The burner casing 57 is divided into two tiers composed of an upper part and a lower part, as shown in FIG. 6, by a rack 59. The upper part functions as a burner mounting part 60, whereas the lower part functions as an air passage forming part 61. In the burner casing 57, the rack 59 ends at a portion near a front side as shown in FIG. 4 (near side in FIG. 6), so that the upper part and the lower part are in communication with each other at the portion. The portion functions as a vertical air passage 70.

The burner casing 57 has a bottom plate 78 (FIG. 5), which is fastened to the other portion of the casing 57 with screws (not shown). The bottom plate 78 has a blower fixing hole 79 at a part of the plate 78. The blower 53 has an air outlet and is fixed by the fixing hole 79. The blower 53 is fixed to the burner casing 57 by attaching a member such as a flange (not shown) around either the fixing hole 79 or the air outlet.

The air passage forming part 61 is an air chamber, to which the blower 53 is attached at a bottom of the part 61, as shown in FIG. 4. In short, the part 61 forms a part of an air supply passage 37.

The burner mounting part 60 defines a space in which the burners 58 is housed and, as shown in FIG. 4, is located over the air passage forming part 61.

Each of the burners 58 has an air-gas inlet 68 at its end and burner ports 62 at its top face. All the burners 58 employed in this embodiment have the same shape and the equal combustion capacity.

Next, the forming unit 55 for forming fuel supply channels will be described in detail below.

The forming unit 55, as shown in FIG. 4, is designed to supply fuel gas to each burner 58 via each nozzle 20. The forming unit 55 forms seven fuel supply channels 89 in accordance with the number of the burner groups 71, so that the fuel supply channels 89 are connected to the burner groups 71 respectively.

The fuel supply channels 89 each have a pipe resistance set in a value corresponding to a combustion capacity of the burner group 71. In this embodiment, since the burners 58 have the same combustion capacity, the value of the pipe resistance of each fuel supply channel 89 is set so as to correspond (inversely proportionally) to the number of the burners 58 of the respective fuel supply channel 89.

Herein, each fuel supply channel 89 may have a portion 81 with a predetermined cross-sectional area corresponding to the combustion capacity of the respective burner group 71.

In this embodiment, the forming unit 55 mainly consists of a main body 63, a front lid 64, and a bottom lid 65.

Figure 9:
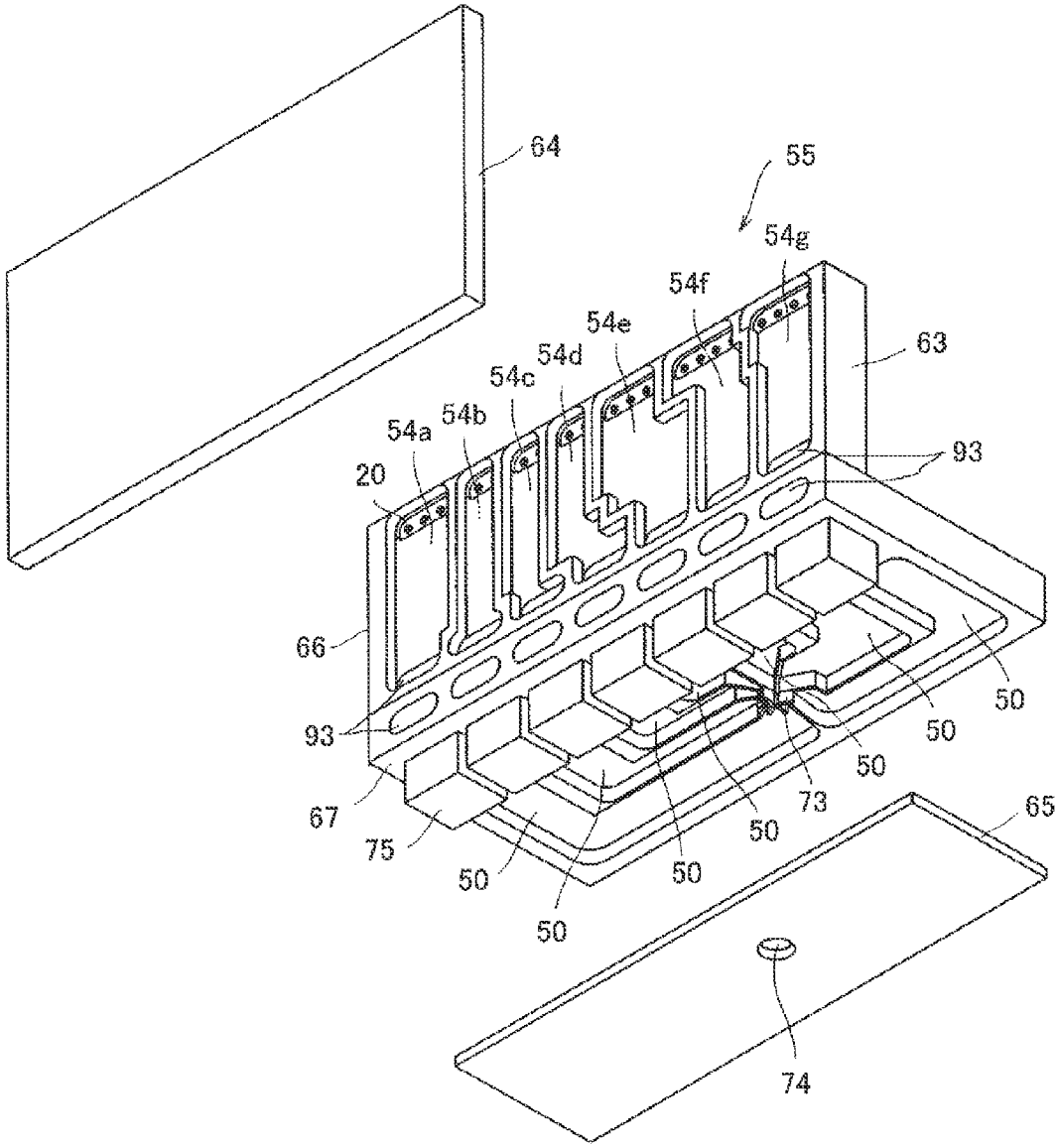
FIG. 9 is a perspective view seen from A in FIG. 8.

The main body 63, as shown in FIG. 9, has an L shape from a lateral view with a combination of a front board 66 and a bottom board 67. The front board 66 and the bottom board 67 both have grooves partitioned by walls or partitions 73.

Figure 10:
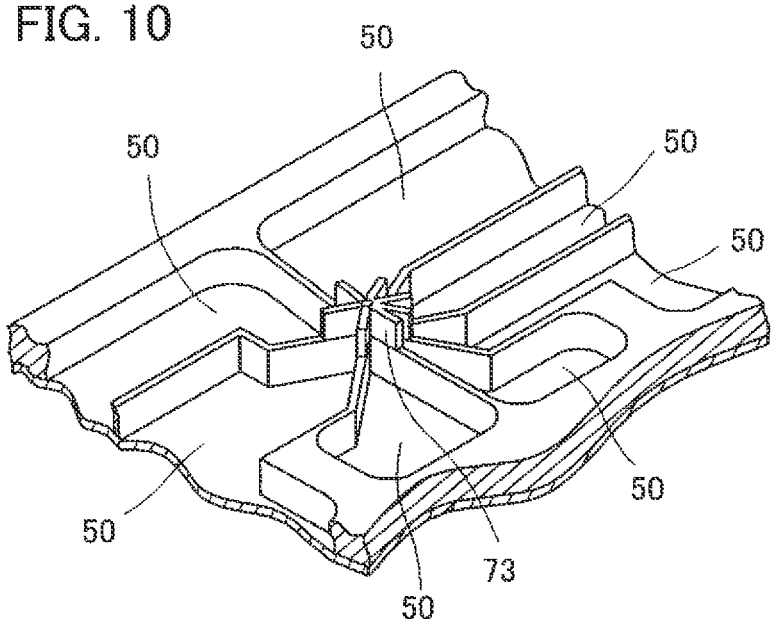
FIG. 10 is a perspective view of a portion in the vicinity of an open-end member of the forming unit without a bottom lid.

Specifically, the bottom board 67 has seven grooves 50 as shown in FIG. 9. The grooves 50 each have a starting point at a substantial center of the bottom board 67. As shown in FIG. 10, parts of all the walls or partitions 73 defining the grooves 50 extend outward at a portion in which the starting points of the grooves 50 concentrate.

On the other hand, ending points of the grooves 50 of the bottom board 67 concentrate in a side where the bottom board 67 is attached to the front board 66, as shown in FIG. 9. Communicating holes 93 are formed on a joint part of the bottom board 67 and the front board 66, so that the grooves 50 formed on the bottom board 67 communicate with grooves 54 formed on the front board 66 respectively.

Further, the communicating holes 93 each are provided with a main valve (not shown) of a solenoid valve (switching valve) 75 within the holes 93 so as to open and close the communicating holes 93 discretely.

Figure 8:
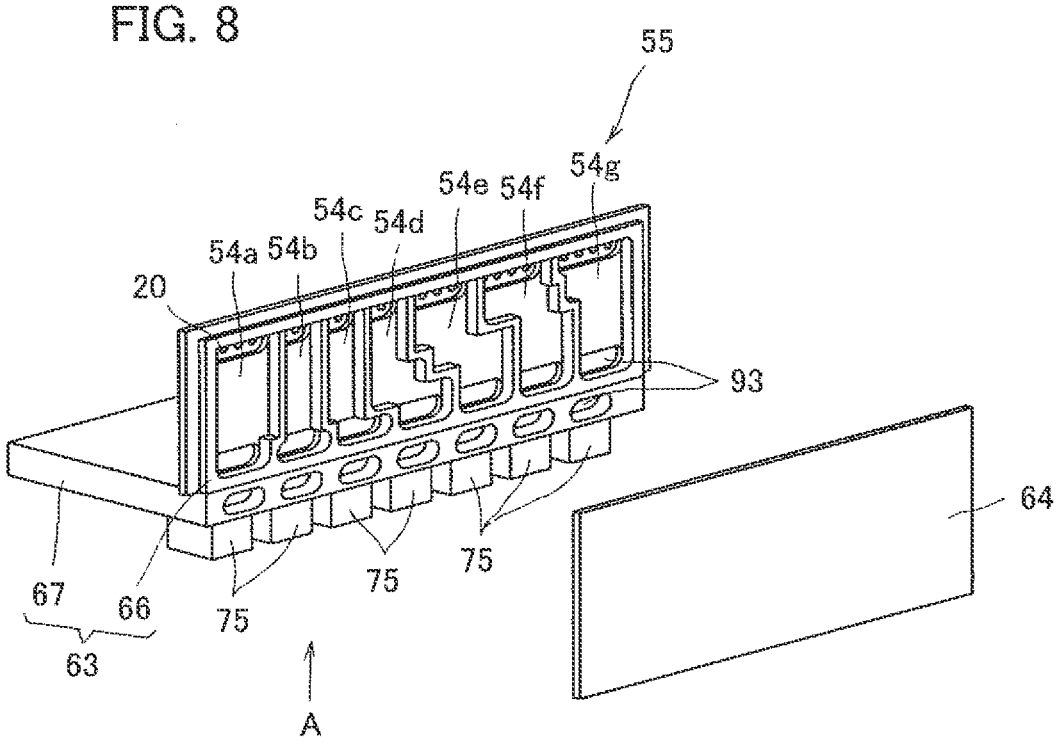
FIG. 8 is an exploded perspective view of a forming unit for forming fuel supply channels.

Meanwhile, the front board 66, as shown in FIGS. 8 and 9, also has seven grooves 54 as described above. Starting points of the grooves 54 are the above-mentioned communicating holes 93, concentrating in the side (joint side) where the bottom board 67 is attached to the front board 66. Ending points of the grooves 54 concentrate in a side (open side) at the opposite of the above-mentioned side of the bottom board 67.

Figure 12:
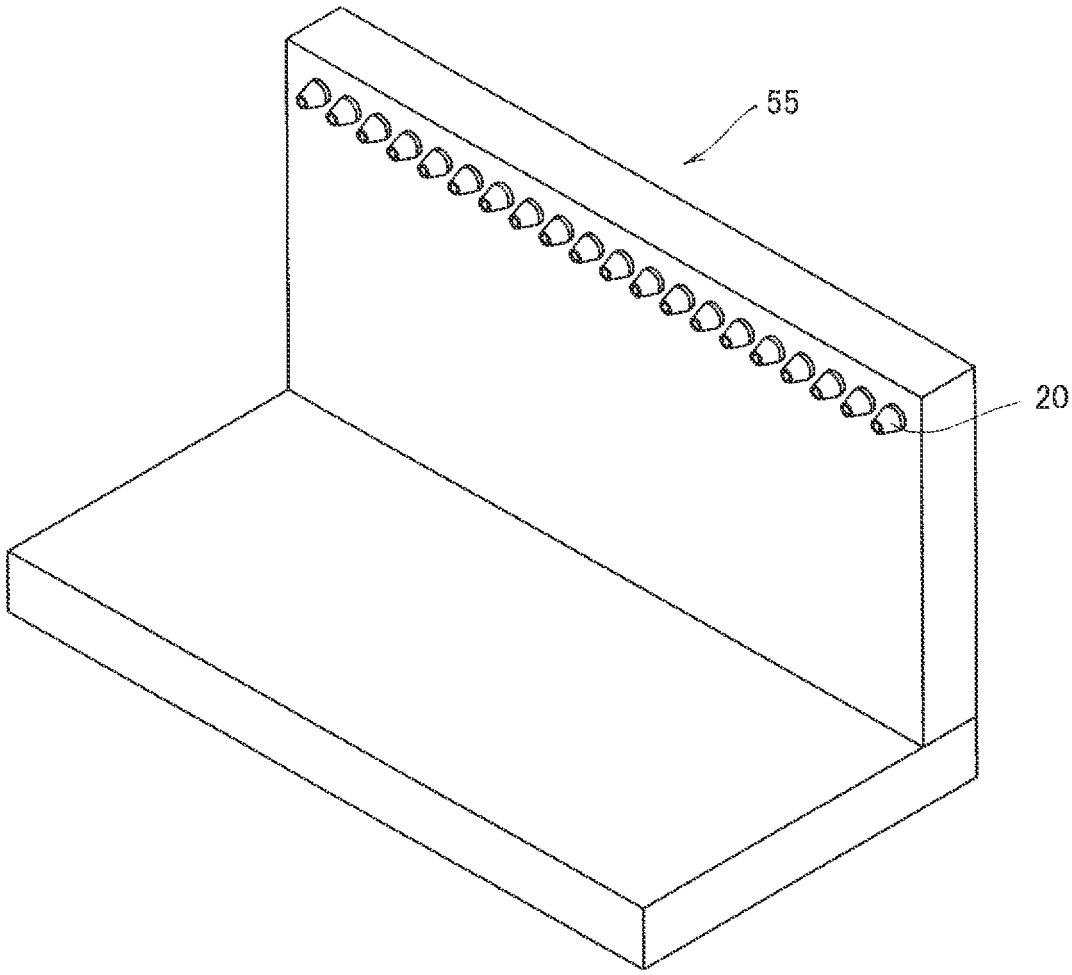
FIG. 12 is a perspective view of the forming unit seen from inside.

There are formed a plurality of through-holes at bottoms of the grooves 54 and adjacent to the open side and communicating with the burner casing 57. The nozzles 20 are attached to the respective through-holes as shown in FIG. 12.

The number of the nozzles 20 corresponds to the number of the burners 58. The nozzles 20 are allocated to the respective grooves 54 so as to correspond to the number of the burners 58 of the respective burner groups 71.

Specifically, a first groove 54*a* has four nozzles 20, a second groove 54*b* has four nozzles 20, a third groove 54*c* has three nozzles 20, a fourth groove 54*d* has two nozzles 20, a fifth groove 54*e* has two nozzles 20, a sixth groove 54*f* has two nozzles 20, and a seventh groove 54*g* has three nozzles 20.

The front lid 64 is attached to the front board 66, whereas the bottom lid 65 is attached to the bottom board 67, whereby the open sides of all the grooves 50 and 54 are sealed. As a consequence, the grooves 54 of the front board 66 each form a flow channel with four faces sealed. In this embodiment, the flow channels defined by the grooves 54 and 50 and the front and bottom lids 64 and 65 function as the fuel supply channels 89 (FIGS. 2 and 4).

Figure 11:
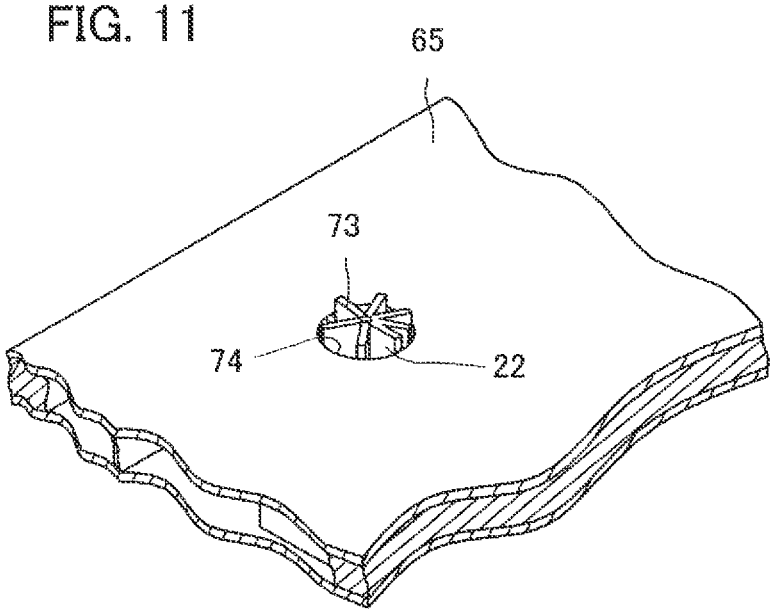
FIG. 11 is a perspective view of the open-end member of the forming unit.

Herein, the bottom lid 65 has an opening 74 (FIG. 9) formed at a portion corresponding to the above-mentioned portion in which the starting points of the grooves 50 concentrate. The above-mentioned extending partitions 73 are exposed on the outside of the opening 74 (FIG. 11).

Thus, the opening 74 of the bottom lid 65 is divided into seven small areas by the partitions 73. In this embodiment, each small area forms an upstream open end of the respective fuel supply channel 89 and a group of seven small areas form an open-end member 22.

In this embodiment, an area of each small open area is proportional to the combustion capacity of the burners 58 of the respective burner group 71.

Next, the pressure regulator 56 employed in this embodiment will be described in detail below.

The pressure regulator 56 is a kind of a pressure reducing valve and is designed to reduce a primary pressure (high pressure) of gas supplied from a gas supply source to a secondary pressure (pressure lower than the primary pressure) so as to discharge the gas with a reduced pressure. The pressure regulator 56 has a signal pressure inlet 82 through which a pressure is introduced as a signal, so as to discharge the gas having the secondary pressure, which has been reduced in response to a pressure introduced through the signal pressure inlet 82.

Figure 13:
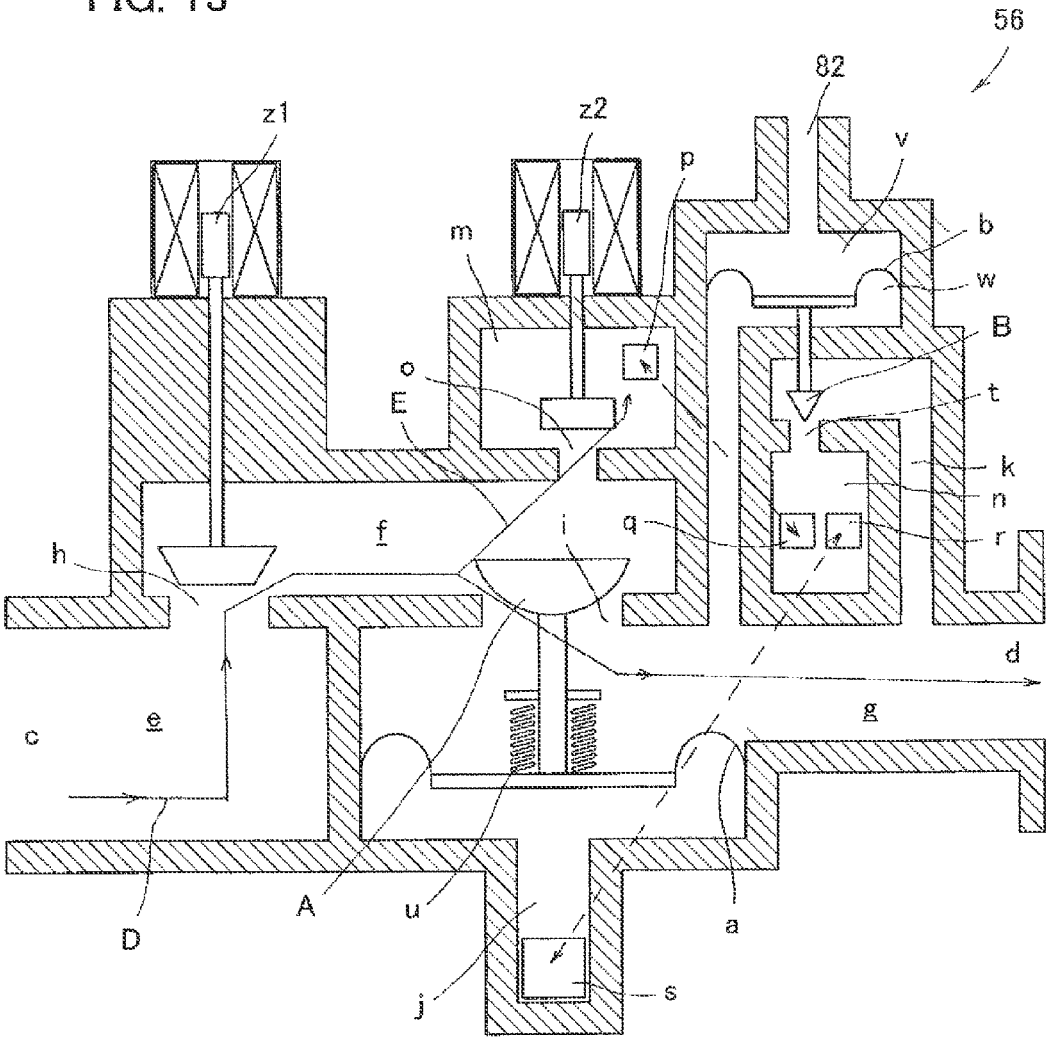
FIG. 13 is a conceptual diagram of a pressure regulator employed in the present embodiment.
Figure 14:
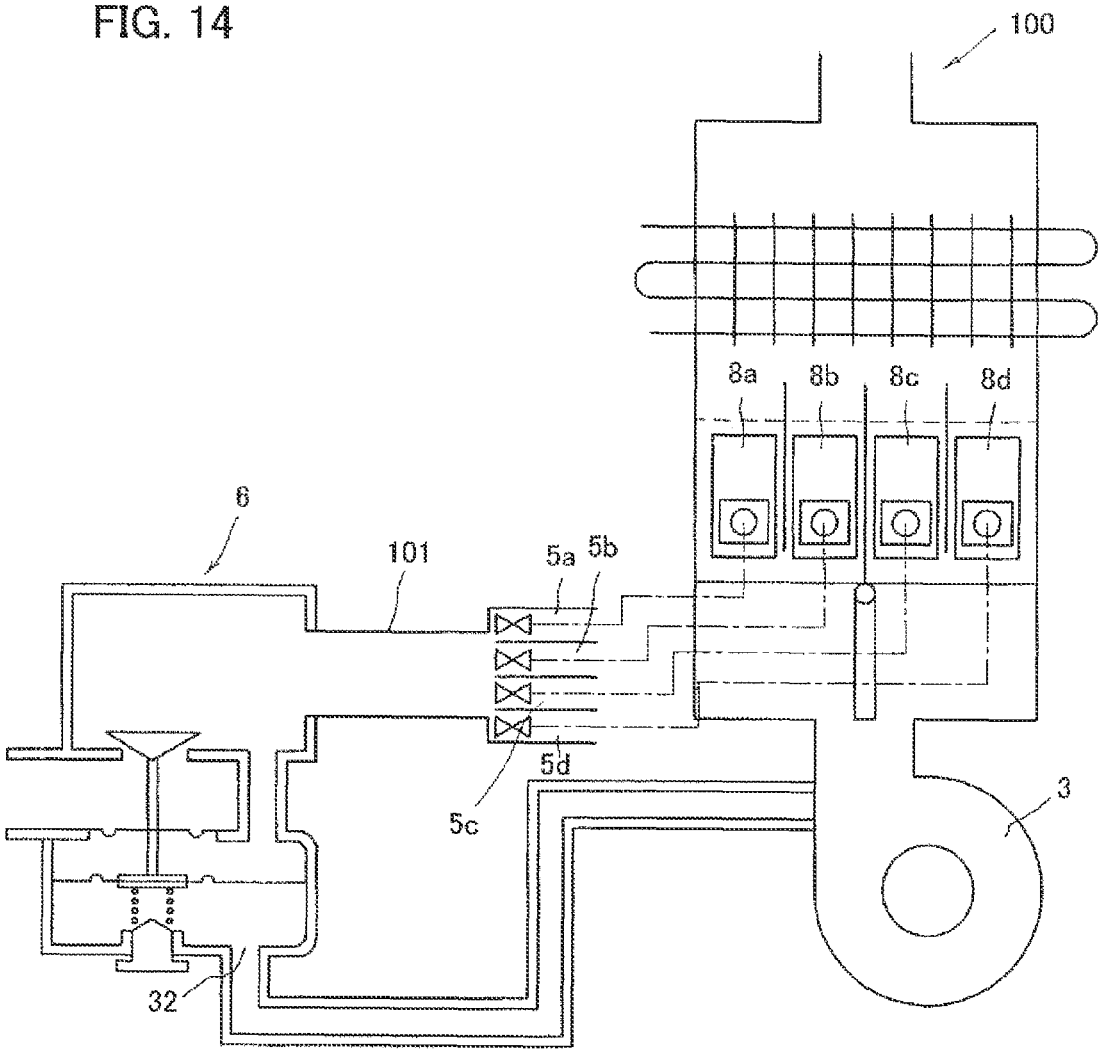
FIG. 14 is a plumbing diagram of a combustion apparatus experimentally produced, showing an embodiment having a common flow channel of fuel gas.

As shown in FIG. 13, the pressure regulator 56 employed in this embodiment is of a pilot type with a main valve A and an auxiliary valve (pilot valve) B. Further, the pressure regulator 56 has a main channel D and an auxiliary channel E therein, the main valve A being disposed in the main channel D and the auxiliary valve B being disposed in the auxiliary channel E.

Herein, the main channel D, which is a flow channel from a gas inlet (c) to a gas outlet (d) of the pressure regulator 56, is designed to reduce a pressure of gas supplied from the gas supply source and to discharge the gas with a reduced pressure.

Specifically, the main channel D is a series of flow channel consisting of an introduction channel (e) leading out of the gas inlet (c), a parallel channel (f), and a discharge channel (g). The introduction channel (e) and the parallel channel (f) are communicated with each other at a first opening (h), whereas the parallel channel (f) and the discharge channel (g) are communicated with each other at a second opening (i).

The main valve A is located in the main channel D and operated by a diaphragm (a). Specifically, the main valve A is disposed at the second opening (i) so as to regulate an opening degree of the second opening (i). In other words, the main valve A is designed to increase and decrease a passing-through area of the second opening (i) of the main channel D. When the main valve A is operated so as to reduce the opening degree, the secondary pressure is reduced. When the main valve A is operated so as to increase the opening degree, the secondary pressure is raised.

The main valve A is operated by the diaphragm (a) as described above. The diaphragm (a) functions as one of walls defining a working pressure chamber (j) located at one side of space with the boundary along the diaphragm (a). The other side of the diaphragm (a) is pressed by a spring (u). Consequently, the diaphragm (a) moves so as to balance a pressure within the working pressure chamber (j) with a pressure of the spring (u), thereby moving a valve body of the main valve A. Herein, the spring (u) has an upper end (FIG. 13), which is fixed to the pressure regulator 56.

The auxiliary channel E, which is a channel diverged from the main channel D, is communicated with the above-mentioned working pressure chamber (j). The auxiliary channel E is further diverged to form a leakage channel (k).

Specifically, the auxiliary channel E is a series of flow channel from a diverging chamber (m) via a pressure regulating chamber (n) to the working pressure chamber (j).

More specifically, the parallel channel (f) of the main channel D is communicated with the diverging chamber (m) via an opening (o) formed in the parallel channel (f). An opening (p) in the diverging chamber (m) is communicated with an opening (q) in the pressure regulating chamber (n) via a conducting channel shown by a dashed line. Further, an opening (r) in the pressure regulating chamber (n) is communicated with an opening (s) in the working pressure chamber (j) via another conducting channel shown by another dashed line.

That forms a series of the auxiliary channel E consisting of the parallel channel (f), the opening (o), the diverging chamber (m), the opening (p), the opening (q), the pressure regulating chamber (n), the opening (r), the opening (s), and the working pressure chamber (j).

Further, the pressure regulating chamber (n) has an opening (t) for leakage, which is communicated with the discharge channel (g) of the main channel D via the leakage channel (k). The opening (t) for leakage is extremely small.

The auxiliary valve B is operated by a diaphragm (b) and disposed at the opening (t) for leakage in the pressure regulating chamber (n). The auxiliary valve B is designed to regulate an opening degree of the opening (t), thereby regulating a pressure in the pressure regulating chamber (n). Specifically, the auxiliary valve B is designed to increase and decrease a passing-through area of the opening (t) for leakage. When the auxiliary valve B is operated so as to reduce the opening degree, a pressure in the pressure regulating chamber (n) is raised. When the auxiliary valve B is operated so as to increase the opening degree, a pressure in the pressure regulating chamber (n) is reduced.

The diaphragm (b) functions as a boundary having one surface on which the secondary pressure exerts and the other surface on which the signal pressure exerts, so as to move in response to intensities of the secondary pressure and the signal pressure.

Specifically, the diaphragm (b) functions as one of walls defining a signal pressure chamber (v) located at one side of space with the boundary along the diaphragm (b). The signal pressure chamber (v) is communicated with the signal pressure inlet 82.

The other side of the diaphragm (b) defines a secondary-pressure communicating chamber (w), which is communicated with the discharge channel (g) of the main channel D via a secondary-pressure communicating passage (x). The secondary-pressure communicating chamber (w) is subjected to the secondary pressure of the pressure regulator 56.

Consequently, the diaphragm (b) defines the signal pressure chamber (v) at one side and the secondary-pressure communicating chamber (w) at the other side and moves so as to balance a pressure within the signal pressure chamber (v) with a pressure within the communicating chamber (w). The signal pressure chamber (v) is subjected to a signal pressure by gas introduced from the signal pressure inlet 82, whereas the secondary-pressure communicating chamber (w) is subjected to the secondary pressure introduced from the communicating passage (x). Thus, the diaphragm (b) moves so as to balance the signal pressure with the secondary pressure.

The pressure regulator 56 employed in this embodiment further includes a first solenoid valve (z1) and a second solenoid valve (z2). The first solenoid valve (z1) is disposed at the first opening (h) of the main channel D and designed to open and close the main channel D.

Meanwhile, the second solenoid valve (z2) is disposed at the opening (o) of the auxiliary channel E and designed to open and close the auxiliary channel E.

Next, function of the pressure regulator 56 in the present embodiment will be described in detail below.

The pressure regulator 56 is used in such a manner that the gas inlet (c) is connected to the gas supply source and the gas outlet (d) is connected to a load (burner) side.

The signal pressure inlet 82 is connected to a desired signal supply source.

In use, the first solenoid valve (z1) and the second solenoid valve (z2) both are open so that the main channel D and the auxiliary channel E both are open.

Fuel gas flows through the main channel D. Specifically, the fuel gas is introduced from the gas inlet (c) into the introduction channel (e) and then in the parallel channel (f). The fuel gas further flows through the second opening (i) to the discharge channel (g), then being discharged from the gas outlet (d).

Herein, the main valve A is disposed at the second opening (i), thereby regulating the flow rate of the fuel gas flowing through the discharge channel (g). Specifically, the fuel gas flowing upstream of the second opening (i) has a primary pressure, which is the same pressure as that of the gas supply source, but the fuel gas flowing downstream of the second opening (i) has a low pressure reduced at the second opening (i).

On the other hand, fuel gas flowing in the auxiliary channel E flows through the diverging chamber (m) into the working pressure chamber (j).

Herein, since the pressure regulating chamber (n) has the opening (t) for leakage, the pressure in the working pressure chamber (j) depends on the opening degree of the opening (t).

When the opening (t) is closed, the auxiliary channel E has a pressure (primary pressure) equal to that in a higher-pressure side (upstream of the second opening (i)) of the main channel D. When the opening (t) is opened, the fuel gas in the pressure regulating chamber (n) leaks through the opening (t), flows through the leakage channel (k), and is discharged into the discharge channel (g) of the main channel D. That reduces the pressure in the pressure regulating chamber (n).

The opening (t) has the auxiliary valve B, which is operated by the diaphragm (b). The diaphragm (b) is located between the signal pressure chamber (v) and the secondary-pressure communicating chamber (w) as described above, and moves so as to balance the pressure in the signal pressure chamber (v) with the pressure in the communicating chamber (w).

Thus, for example, when the signal pressure increases, the pressure in the signal pressure chamber (v) is increased, so that the diaphragm (b) bulges downwardly in the figure. The bulged diaphragm (b) pushes down the valve body of the auxiliary valve B, which narrows the opening degree of the opening (t). That reduces the flow amount of the fuel gas leaking through the opening (t), so that the pressure in the pressure regulating chamber (n) is increased. That increases the pressure in the working pressure chamber (j) communicated with the pressure regulating chamber (n), whereby the diaphragm (a) bulges against the force of the spring (u) and pushes up the valve body of the main valve A. That widens the opening degree of the second opening (i) so as to increase the flow amount of the fuel gas flowing through the second opening (i), whereby a pressure (secondary pressure) in a lower-pressure side (downstream of the second opening (i)) is increased. Shortly, increase of the signal pressure increases the secondary pressure of the fuel gas.

The same can be said to a case where the secondary pressure of the fuel gas is reduced for some reason. The pressure in the secondary-pressure communicating chamber (w) is reduced, whereby the diaphragm (b) bulges downwardly in the figure. The bulged diaphragm (b) pushes down the valve body of the auxiliary valve B, which narrows the opening degree of the opening (t). That reduces the flow amount of the fuel gas leaking through the opening (t), so that the pressures in the pressure regulating chamber (n) and the working pressure chamber (j) are increased. Thereby, the diaphragm (a) bulges against the force of the spring (u) and pushes up the valve body of the main valve A. That widens the opening degree of the second opening (i), whereby a pressure in a lower-pressure side (downstream of the second opening (i)) is increased. Shortly, when the secondary pressure of the fuel gas is reduced, the valve body of the main valve A moves so as to correct such a condition, so that the secondary pressure of the fuel gas is increased.

Conversely, when the signal pressure is reduced, the pressure in the signal pressure chamber (v) is reduced and the diaphragm (b) moves upwardly in the figure under pressure from the secondary-pressure communicating chamber (w). The diaphragm (b) opens the auxiliary valve B, thereby increasing the flow amount of the fuel gas leaking through the opening (t), so that the pressure in the pressure regulating chamber (n) is reduced. That reduces the pressure in the working pressure chamber (j) communicated with the pressure regulating chamber (n). As a consequence, the diaphragm (a) is moved downwardly in the figure by a force of the spring (u), so as to push down the valve body of the main valve A. That narrows the opening degree of the second opening (i), reducing the flow amount of the fuel gas flowing through the second opening (i), so that the pressure in the lower-pressure side (downstream of the second opening (i)) is reduced. Shortly, reduction of the signal pressure reduces the secondary pressure of the fuel gas accordingly.

The same can be said to a case where the secondary pressure of the fuel gas is increased. The pressure in the secondary-pressure communicating chamber (w) is increased, whereby the diaphragm (b) moves upwardly in the figure. The diaphragm (b) pushes up the valve body of the auxiliary valve B, which widens the opening degree of the opening (t). That increases the flow amount of the fuel gas leaking through the opening (t), so that the pressures in the pressure regulating chamber (n) and the working pressure chamber (j) are reduced. Thereby the diaphragm (a) moves downwardly in the figure and pushes down the valve body of the main valve A. That narrows the opening degree of the second opening (i), whereby the pressure in the lower-pressure side (downstream of the second opening (i)) is reduced. Shortly, when the secondary pressure of the fuel gas is increased, the valve body of the main valve A moves so as to correct such a condition, so that the secondary pressure of the fuel gas is reduced.

In the above-mentioned pressure regulator 56, the gas inlet 30 is connected to the fuel gas supply source. Further, the gas outlet 31 of the pressure regulator 56 is attached to the opening 74 formed in the bottom lid 65 of the forming unit 55 for forming fuel supply channels. Specifically, the gas outlet 31 of the pressure regulator 56 has a flange (not shown), which is fastened to the opening 74 with screws, so that the gas outlet 31 is fit in the opening 74.

The partitions 73 extend out of the opening 74 of the forming unit 55, thus being inserted into the gas outlet 31 so as to partition the inside of the gas outlet 31 into seven areas.

Figure 5:
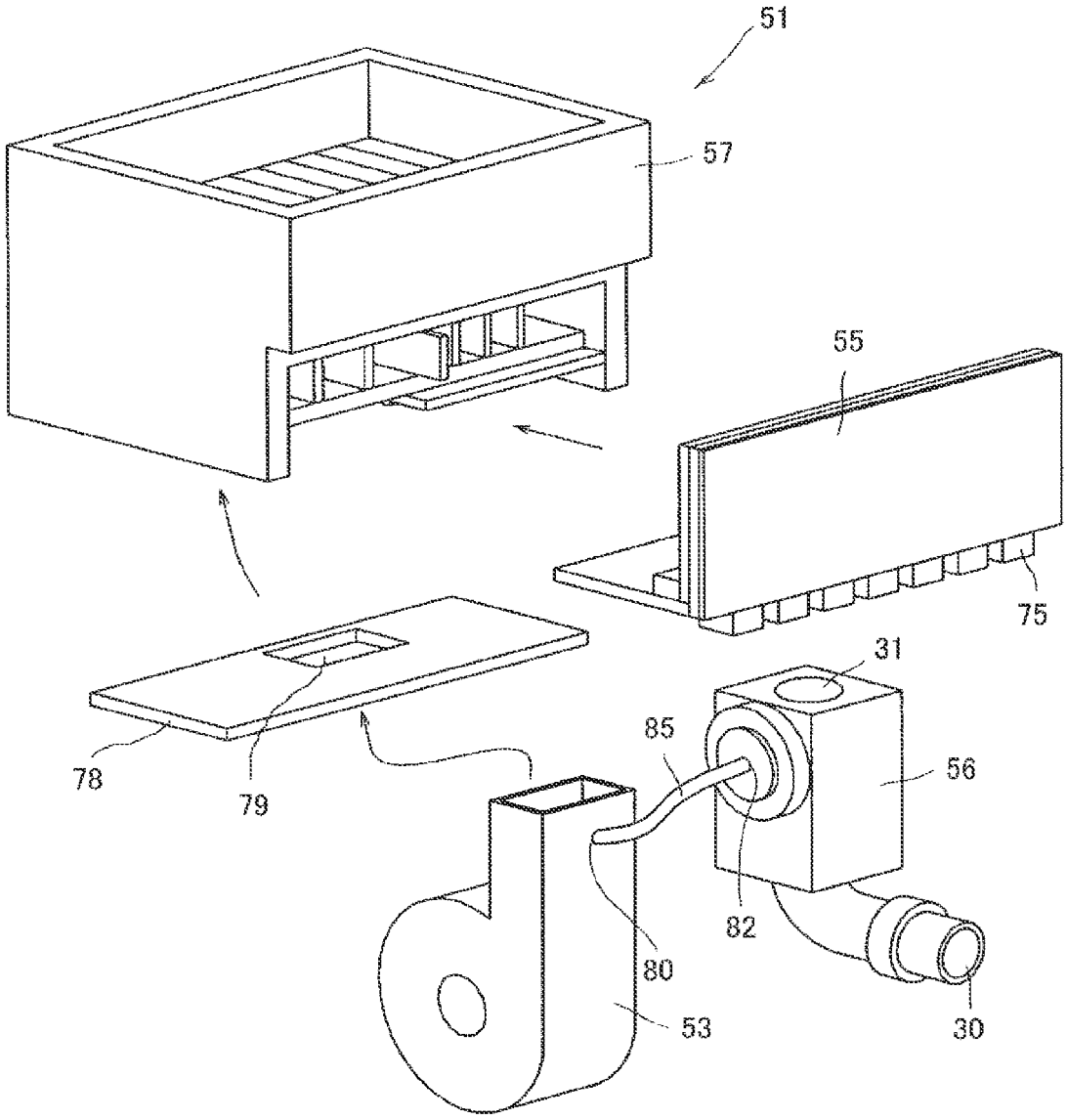
FIG. 5 is an exploded perspective view of the combustion apparatus in FIG. 1.

The signal pressure of the pressure regulator 56 is sensed from the vicinity of the outlet of the blower 53. Specifically, as shown in FIG. 5, the portion 80 for taking out a signal pressure of the blower 53 is connected to the signal pressure inlet 82 of the pressure regulator 56 via a conducting pipe 85.

Next, function of the combustion apparatus 51 will be described in detail below.

In the combustion apparatus 51 of the present embodiment, the switching valves 75 are opened with operating the blower 53. Fuel and air are introduced into the burners 58, in which the fuel and the air are mixed to produce a fuel-air mixture gas. The mixture gas is discharged from the burner ports 62 of the burners 58 so as to generate flame within a combustion space 86.

More specifically, the blower 53 is operated so as to feed air into the burner casing 57. The air fed from the blower 53 is introduced into the air passage forming part 61 in the burner casing 57, then passing from the part 61 through the vertical air passage 70 (FIG. 4), which is a portion where the rack 59 ends, and coming over the rack 59. Then, the air reaches the ends of the burners 58, so as to be supplied to each of the burners 58 through the air-gas inlets 68.

As for the amount of air to be introduced into each burner 58, it varies as a function of an air pressure in the vicinity of the air-gas inlet 68 of the burner 58, an opening area of the air-gas inlet 68, an internal resistance of the burner 58, a resistance (exhaust air resistance) at downstream of the burner 58, and an atmospheric pressure.

The opening area of the air-gas inlet 68 remains unchanged during combustion. The internal resistance in the burner 58 is also constant. Further, it is taken for granted that the resistance at downstream of the burner 58 and the atmospheric pressure are substantially constant.

Thus, variation of the amount of air to be introduced into the burner 58 correlates most strongly with change of air blow pressure in the vicinity of the air-gas inlet 68. That is, it is practically convenient to regard that the amount of air introduced into the burner 58 is varied only by changing of a pressure in the vicinity of the air-gas inlet 68.

It may be said that the pressure in the vicinity of the air-gas inlet 68 is determined by a discharge pressure of the blower 53, treating a condition such as pressure loss in the burner 58 with disregard.

On the other hand, the fuel gas is introduced from the fuel gas supply source into the pressure regulator 56, which reduces the pressure of the fuel gas. The regulated fuel gas flowing out of the pressure regulator 56 enters the forming unit 55 for forming fuel supply channels, flows through the fuel supply channels 89, and is discharged through the nozzles 20. The nozzles 20 each are disposed at a position opposite the air-gas inlet 68 of the respective burner 58. The fuel gas discharged from each nozzle 20 enters the respective burner 58 through the air-gas inlet 68, so as to be mixed with air and to be discharged from the burner ports 62.

In the present embodiment, twenty burners 58 are divided into seven burner groups 71. As for the amount of fuel gas to be introduced into each burner group 71, it is equal to the amount of fuel gas flowing through the respective fuel supply channel 89.

The amount of fuel gas flowing through the fuel supply channel 89 varies as a function of a gas pressure at upstream of the fuel supply channel 89, an opening area of the fuel supply channel 89, an internal resistance of the fuel supply channel 89, opening diameters of the nozzles 20, and an atmospheric pressure at a discharge side of the nozzles 20.

Herein, the upstream open end of each fuel supply channel 89 is formed by the respective small area in the opening 74 of the bottom lid 65. In this embodiment, an area of the small area is proportional to a total combustion capacity of the burners 58 making up each burner group 71.

Therefore, a ratio between the flow amounts of fuel gas flowing in any fuel supply channels 89 is equal to a ratio between combustion capacities (the number of burners) of the respective burner groups 71. The same number of the nozzles 20 as that of the burners 58 making up each fuel supply channel 89 are disposed at the end of the channel 89, so as to divide fuel gas flowing through the channel 89 into the respective burners 58. The fuel gas is therefore supplied evenly to all the burners 58.

As for the amount of fuel gas to be introduced into each burner 58, it is determined by the amount of fuel gas flowing through the respective fuel supply channel 89.

The amount of fuel gas flowing through the fuel supply channel 89 varies as a function of the gas pressure at upstream of the fuel supply channel 89, the opening area of the fuel supply channel 89, the internal resistance of the fuel supply channel 89, the opening diameters of the nozzles 20, and the atmospheric pressure at the discharge side of the nozzles 20.

The opening area and the internal resistance of the fuel supply channel 89 and the opening diameters of the nozzles 20 remain unchanged during combustion. Further, the atmospheric pressure at the discharge side of the nozzles 20 is substantially constant.

Thus, variation of the amount of fuel gas to be introduced into the burner 58 correlates most strongly with changing of a gas pressure at upstream of the fuel supply channel 89. That is, it is practically convenient to regard that the amount of fuel gas to be introduced into the burner 58 depends on only by the gas pressure at upstream of the fuel supply channel 89.

It is also practically convenient to regard that the amount of fuel gas flowing through the fuel channel 89 changes depending on a discharge pressure of the pressure regulator 56 and that the amount of fuel gas to be introduced into the burner 58 is determined only by the discharge pressure of the pressure regulator 56 since the gas outlet 31 of the pressure regulator 56 is directly connected to the open ends (open-end member 22) of the fuel supply channels 89.

The combustion apparatus 51 in this embodiment senses a signal pressure of the pressure regulator 56 from the vicinity of the outlet of the blower 53. The pressure regulator 56 discharges fuel gas at a secondary pressure correlating with the signal pressure. Therefore, a pressure of fuel gas discharged from the pressure regulator 56 changes depending on a discharge pressure of the blower 53. Consequently, a ratio of the amounts of air and fuel gas to be introduced into each burner 58 is constant at all times.

Therefore, in this embodiment, air and fuel gas are introduced into any of the burners 58 at an appropriate ratio at all times, so as to be mixed and to be discharged from the burner ports 62, thereby generating flame.

Increase and decrease of a combustion amount can be done by variation of the amount of air blow from the blower 53. That is because, as described above, the ratio between the amounts of air and fuel gas introduced into each burner 58 is constant at all times.

Further, closing of some of the switching valves 75 can change the number of burners 58 in use for combustion.

Thus, the combustion apparatus 51 in this embodiment has an effect of a high turndown ratio obtained by a combination of regulation of the combustion amount by variation of the amount of air blow with regulation of the combustion amount by changing of the number of the burners 58 in use for combustion.

Further, in the combustion apparatus 51 in this embodiment, a plurality of fuel supply channels 89 supply fuel discretely to the respective burner groups 71. The gas outlet 31 of the pressure regulator 56 is directly connected to the forming unit 55 for forming fuel supply channels so that an outlet side of the pressure regulator 56 is immediately divided so as to be connected to the respective fuel supply channels 89. Herein, it is 3-10 cm from the gas outlet 31 of the pressure regulator 56 to the upstream ends of the forming unit 55.

That is, since fuel gas regulated in pressure by the pressure regulator 56 is immediately distributed to the forming unit 55, the combustion apparatus 51 in this embodiment provides a structural feature such that the flow channel through which the fuel gas commonly flows is extremely short.

Thus, fluctuation of resistance in the whole channel is small even with changing of the number of burners 58 in use for combustion since the common flow channel of fuel gas is extremely short. Consequently, the combustion apparatus 51 in this embodiment achieves a stable combustion since an air-fuel ratio of the burners 58 already in use for combustion changes extremely little in a case of closing or opening of some of the switching valves 75.

The invention claimed is:

1. A combustion apparatus, comprising:

a plurality of burners;

a plurality of fuel supply channels through which fuel to be supplied to the burners passes:

a blower for supplying air to the burners;

an air supply passage disposed downstream of the blower and through which air to be supplied to the burners passes; and a pressure regulator having a gas outlet formed downstream in a gas flowing direction, being configured to regulate gas supplied at a primary pressure to gas at a secondary pressure in response to a predetermined signal pressure sensed from at least one selected from a part of the air supply passage and the blower, and discharging the regulated gas through the gas outlet, the burners being divided into a plurality of burner groups each consisting of at least one of the burners, the pressure regulator being branched at a portion located immediately after the gas outlet so that the portion is connected to the respective fuel supply channels, and the fuel supply channels each being configured to supply fuel to the respective burner groups and being provided with a switching valve for either shutting off or reducing fuel supply to at least a part of the burner groups.

2. The combustion apparatus as defined in claim 1, wherein the fuel supply channels have respective upstream open ends located at a same position to form an open-end member, to which the pressure regulator is connected at the portion located immediately after the gas outlet.

3. The combustion apparatus as defined in claim 2, the open-end member being formed by the open ends radially arranged, wherein the fuel supply channels extend from the open ends so as to define an imaginary plane, and wherein the gas outlet of the pressure regulator is connected to the open-end member from a direction having vertical component relative to the imaginary plane.

4. The combustion apparatus as defined in claim 2, wherein the fuel supply channels each have an open area at the open-end member depending on a combustion capacity of the respective burner group.

5. The combustion apparatus as defined in claim 1, wherein the fuel supply channels each have a portion with a predetermined cross-sectional area corresponding to a combustion capacity of the respective burner group and/or a flow resistance corresponding to a combustion capacity of the respective burner group.

* * * * *